United States Patent [19]

Itagaki

[11] Patent Number: 5,058,845

[45] Date of Patent: Oct. 22, 1991

[54] INCLINATION ANGLE-ADJUSTABLE SUPPORTING DEVICE FOR DISPLAY

[75] Inventor: Takafumi Itagaki, Chiba, Japan

[73] Assignee: Tamatoshi Industries Limited, Tokyo, Japan

[21] Appl. No.: 486,820

[22] Filed: Mar. 1, 1990

[51] Int. Cl.[5] ..... E04G 3/00

[52] U.S. Cl. ..... 248/291; 248/180

[58] Field of Search ..... 248/291, 242, 243, 180, 248/188.4

[56] References Cited

U.S. PATENT DOCUMENTS

| | | | |
|---|---|---|---|
| 550,779 | 12/1895 | Buchholz | 248/291 X |
| 2,136,109 | 11/1938 | Kress | 248/242 X |
| 2,329,978 | 9/1943 | Brunson | 248/180 |
| 2,624,537 | 1/1953 | Rouy | 248/180 |
| 4,531,331 | 7/1985 | Itagaki . | |
| 4,598,504 | 7/1986 | Itagaki . | |
| 4,684,286 | 8/1987 | Itagaki . | |

FOREIGN PATENT DOCUMENTS

| | | | |
|---|---|---|---|
| 2042270 | 8/1970 | Fed. Rep. of Germany | 248/242 |
| 20420 | 10/1895 | United Kingdom | 248/242 |
| 279992 | 11/1927 | United Kingdom | 248/242 |

*Primary Examiner*—Alvin C. Chin-Shue

*Attorney, Agent, or Firm*—Longacre & White

[57] ABSTRACT

An inclination angle-adjustable supporting device to be used for a display by attaching it to a display apparatus or a display wall. This supporting device comprises an outer cylindrical member having a hollow housing portion at its proximal end portion, a basic rod member housed in the housing portion of the outer cylindrical member in such a manner that the distal end portion thereof is pivoted on the outer cylindrical member so as to allow the outer cylindrical member to incline, and an adjustment screw adapted to be inserted through the bottom surface of the outer cylindrical member and to allow the distal end portion thereof to push on the bottom surface of the basic rod member, thereby to perform the adjustment of the inclination angle of the outer cylindrical member. The basic rod member may be housed in the outer cylindrical member through an adaptor.

15 Claims, 4 Drawing Sheets

1
2
2A
2a
3
3a
4
5
6
7
7a
8
9
S
P

INCLINATION ANGLE-ADJUSTABLE SUPPORTING DEVICE FOR DISPLAY

BACKGROUND OF THE INVENTION (a). Field of the Invention

This invention relates to a supporting device for display, and more particularly to an inclination angle-adjustment structure of the supporting device for adjusting the projecting angle of the supporting device.

(b). Description of the Prior Art

A supporting device for display, which is adapted to be mounted on a display apparatus or a display wall so as to be used for example as a hanger, a hook, a bracket or a shelf support, and provided with a mechanism for inclining the projecting outer pipe thereof, is conventionally known. For example, Published Unexamined Japanese Patent Application No 59-93285 discloses a supporting device whose outer cylindrical member consisting of a rod-like body is provided with an angle-adjustment mechanism so that the fixing angle thereof can be adjusted upward or downward in stepwise.

The angle-adjustment mechanism disclosed therein however is rather complicated in structure and most of the mechanism is exposed and protruded outward, so that the angle-adjustment mechanism is easily deformed as it is collided with a hard object, or easily got out of order by the intrusion of dust or by the generation of rust Further, because of this extruding structure of the angle-adjustment mechanism, the external appearance of the supporting device is also spoiled.

SUMMARY OF THE INVENTION

The present invention has been accomplished in view of above circumstances, and has it object to provide an angle-adjustable supporting device for display, which is simple in structure and attractive in external appearance.

Above object has been attained according to the present invention by building the angle-adjustment mechanism in the interior of a forwardly extending outer cylindrical member of the supporting device.

Namely, the present invention provides a supporting device having an inclination angle-adjustable structure and adapted to be used for display, which comprises a basic rod member to be projectingly installed and having a connecting portion to be detachably connected to a display apparatus; an outer cylindrical member to be projectingly installed and having a hollow housing portion for fitting said basic rod member therein, said basic rod member being pivotally connected to a portion of said outer cylindrical member falling between the balancing portion and the proximal end of said outer cylindrical member in such a manner that a space is preserved in said housing so as to allow a pivotal movement of said basic rod member in said housing portion; and a adjustment screw engaging with a screw hole provided at a bottom portion of said outer cylindrical member in such a manner that the distal end portion of said screw is adapted to be brought into contact with said basic rod member.

BRIEF DESCRIPTION OF THE DRAWINGS

Other features and advantages of the invention will be apparent from the following description taken in connection with the accompanying drawings wherein.

DESCRIPTION OF THE PREFERRED EMBODIMENT

Figures 1, 2, 3, 4:
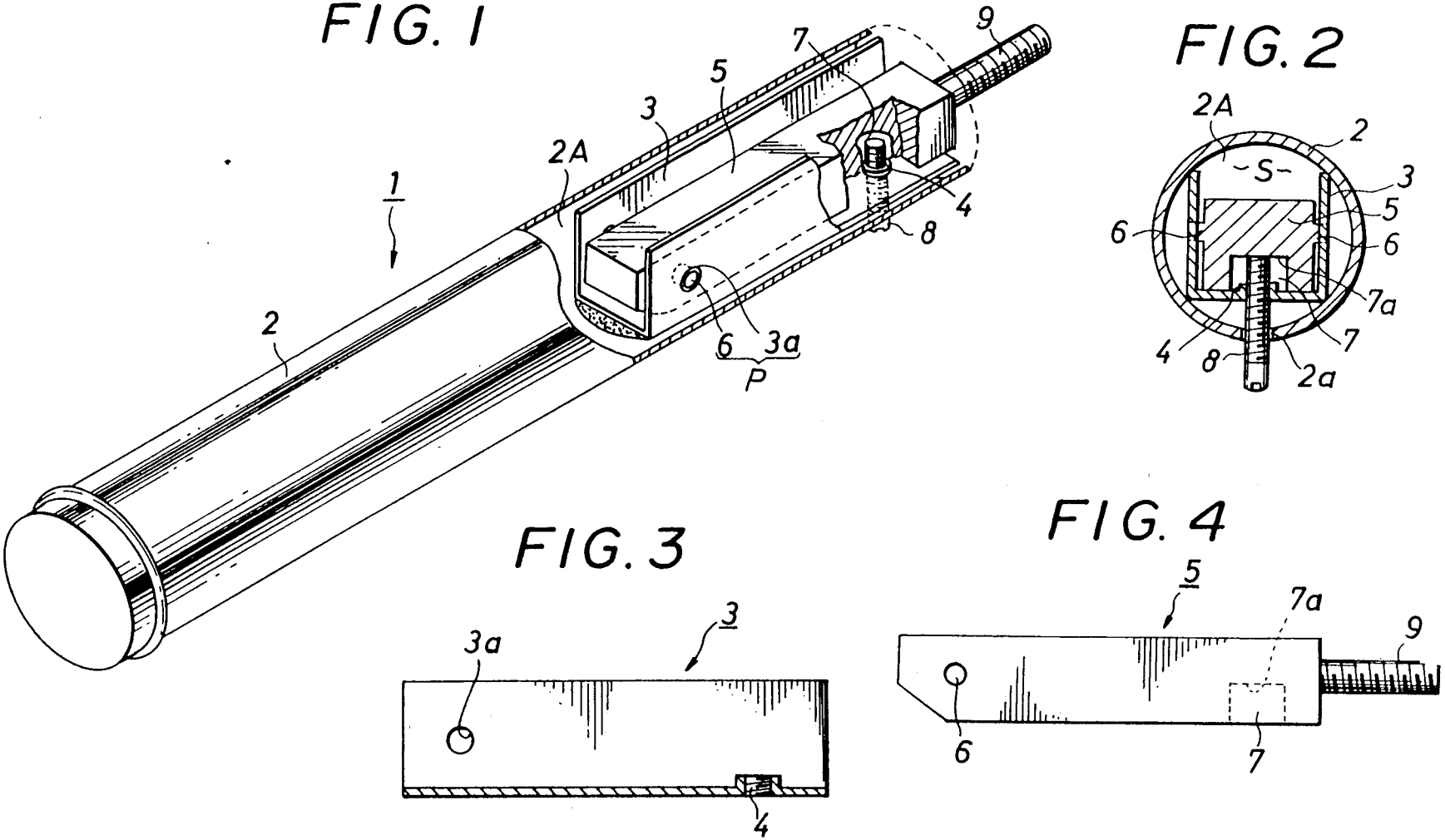
FIG. 1 is a perspective view of an angle-adjustment structure of a supporting device for display according to one embodiment of this invention.
FIG. 2 is a sectional view of an angle-adjustment structure.
FIG. 3 is a longitudinal sectional view of an adaptor.
FIG. 4 is a side view of the basic rod member.

Referring to FIG. 1 and 2, a supporting device 1 to be used as part of a display apparatus comprises an outer cylindrical member 2 having a circular cross section, an adaptor 3 fixed in the outer cylindrical member 2, a basic rod member 5 whose distal end portion is pivotally connected to the adaptor 3, and an adjustment screw 8 which is adapted to be screwed into a screw hole 4 formed on the bottom of the adaptor 3 and the distal end portion of which is adapted to be contacted with the basic rod member 5.

The outer cylindrical member 2 comprises as shown in FIG. 2 a tubular body (or cylindrical shape in the case of embodiment shown in FIG. 2) with at least proximal end thereof being left open, the hollow portion thereof being constituted as a hollow housing portion 2A.

On the bottom of the outer cylindrical member 2 is formed a through hole **2*a*, which is located near the proximal end of the outer cylindrical member 2**.

As long as the outer cylindrical member 2 is provided with the housing portion 2A, the whole structure of the outer cylindrical member 2 is not confined to those of cylindrical shape, but may take any desired shape in construction.

The adaptor 3 which is housed in the housing portion 2A of the outer cylindrical member 2 is channel-like in cross-section, and is provided on its bottom near the proximal end thereof a screw hole (female screw) 4 passing through the bottom thereof. Further, this screw hole 4 is coaxially communicated with the through hole **2*a* of the outer cylindrical member 2**.

On each of the side walls of the adaptor 3 and near the distal end of the adaptor 3 is formed a bearing hole **3*a*** facing each other.

The adaptor 3 is integrally welded and fixed to the outer cylindrical member 2. The adaptor 3 may be fixed to the outer cylindrical member 2 by means of a screw or the like.

The basic rod member 5 is formed of for example a rod-like body having a rectangular shape in cross-section, as shown in FIGS. 1.

On both sides of the distal end portion of the basic rod member 5 are attached a pair of shafts 6 coaxially protruding in perpendicular to the axis of the basic rod member 5 and in opposite to each other, each being fitted in the bearing hole 3*a* thereby allowing the basic rod member 5 to rotate around the pivot point "P", to be freely inclined.

The basic rod member 5 is made smaller in cross-section than that of the adaptor 3, so that when the basic rod member 5 is fitted in the housing portion 2A, a space "S" is formed between the top surface of the basic rod member 5 and the upper inner wall of the outer cylindrical member 2, or in the rotating direction of the outer cylindrical member 2.

The position of the pivot point "P" is set at a point located on a proximal end side of the longitudinal balance point of the outer cylindrical member 2 (in this embodiment, an outer cylindrical member integrally confined with the adaptor 3).

The bottom portion of the distal end portion (or the bottom corner portion, of the basic rod member 5 is preferably chamfered as shown in FIG. 4 in order to avoid the bottom corner portion of the basic rod member 5 from striking to the bottom surface of the adaptor 3 in the rotational movement of the outer cylindrical member 2.

The basic rod member 5 is also provided on the bottom thereof with a blind hole 7 having a larger inner diameter than that of the screw hole 4 provided on the adaptor 3, and communicating, when the basic rod member 5 is fitted in the adaptor 3, with the screw hole 4. This blind hole 7 is extending in a direction perpendicular to the axis of the shaft 6.

The adjustment screw 8 is inserted from the through hole 2*a* of the outer cylindrical member 2, and screwed into the screw hole 4 of the adaptor 3 with its distal end portion being inserted into the blind hole 7 of the basic rod member 5. This adjustment screw 8 is required to have a sufficiently long length so that the outer cylindrical member 2 can be rotated to any desired angle in relative to the basic rod member 5 while being pushed on through the bottom surface 7*a* of the blind hole 7 by the distal end of the adjustment screw 8.

Since the head portion of the adjustment screw 8 is dispensed with an enlarged guard portion, and has the same outer diameter as that of screw portion, a portion projecting from the outer cylindrical member 2 is not bulky, and, when the outer cylindrical member 2 is inclined, the head portion of the adjustment screw 8 is substantially completely inserted into the through hole 2*a*. This feature is preferable in view of enhancing the external appearance of the supporting device as a whole.

The basic rod member 5 is provided on its proximal end thereof with a connecting portion 9 consisting, in the case of this embodiment, of a screw rod coaxially extending from the basic rod member 5.

Figure 5:
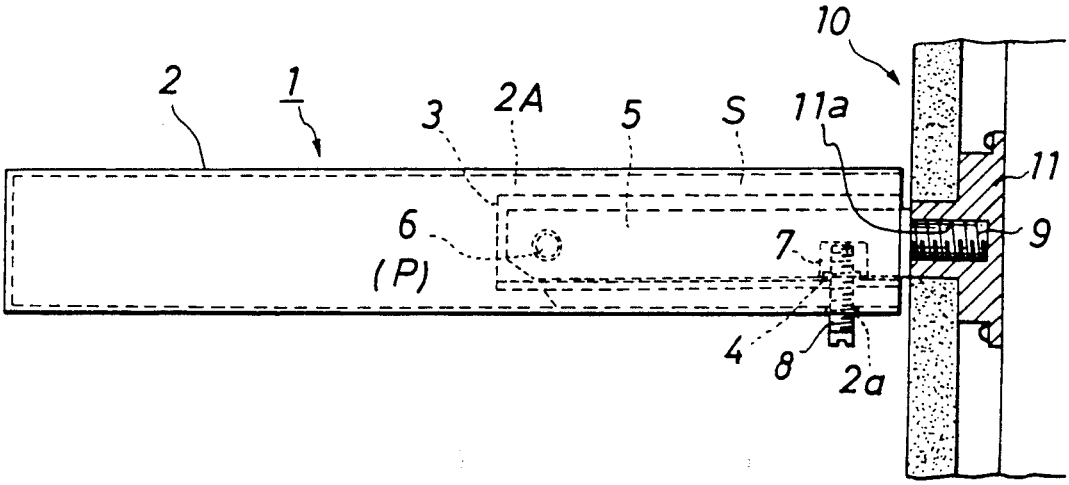
FIG. 5 is a side view showing a supporting device of this invention being mounted on a wall surface.
Figure 6:
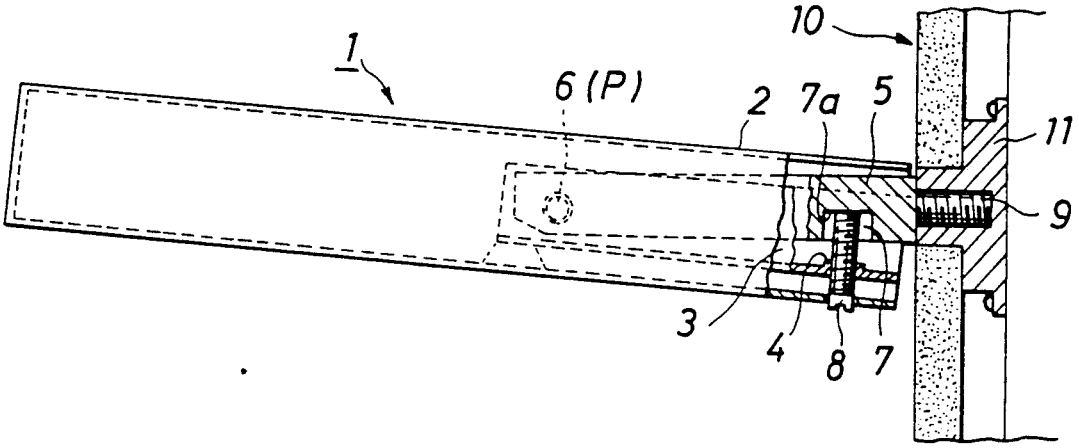
FIG. 6 is a side view of the supporting device for explaining a a status of the supporting device as it is inclined from the horizontal state shown in FIG. 5.

Meanwhile, a display apparatus 10 on which the supporting device 1 can be detachably mounted is separately prepared. This display apparatus 10 is provided with a receiving hole 11 (in this embodiment, a female screw) to be engaged the connection portion 9 of the basic rod member 5, as shown in FIG. 5.

The assembling method and function of the supporting device 1 for display having the above construction will be explained below.

First, each of the shafts 6 of the basic rod member 5 is fitted in each of the bearing holes 3*a* of the adaptor thereby pivotally mounting the basic rod member 5 on the adaptor 3.

Thereafter, this assembled body is inserted into the housing portion 2A of the outer cylindrical member 2, and subsequently the adaptor 3 is welded to the outer cylindrical member 2 for fixing the adaptor 3 thereto.

Then, the adjustment screw 8 is inserted from the through hole 2*a* of the outer cylindrical member 2, and screwed into the screw hole 4 of the adaptor 3 to such an extent that the distal portion thereof is inserted into the blind hole 7 of the basic rod member 5, thereby accomplishing the assembling operation.

This assembled supporting device 1 is then fixed to the display apparatus 10 by fitting the connecting portion 9 in the receiving hole 11*a* (a female screw as shown in FIG. 5) so as to fastening the basic rod member 5 to the display apparatus 10.

As a result, the outer cylindrical member 2 as well as the adaptor 3 are rotated around their pivot point "P", raising their proximal ends upward until the inner bottom surface of the adaptor 3 is brought into contact with the bottom surface of the basic rod member 5. The supporting device 1 is kept fixed in this state.

Therefore, the shape of the bottom of adaptor 3 is so designed in advance as to choose this state as a standard state (for example, the horizontal state).

If it is desired to incline the distal end of the outer cylindrical member 2 upward, the adjustment screw 8 is further screwed forward, thereby pushing its distal end on the bottom surface 7*a* of the blind hole 7 of basic rod member 5, and causing the adaptor 3 to rotate around its pivot point "P" in such a direction that the proximal end portion of the adaptor is gradually departed from the basic rod member 3 (i.e. the proximal end portion of the adaptor 3 is descended, and the distal end portion thereof is ascended).

The range of this inclination is confined to the height of the space "S" formed in the housing portion 2A.

Since the outer cylindrical member 2 is integrally fixed to the adaptor 3, the outer cylindrical member 2 can be also inclined to a desired angle together with the adaptor 3.

Figure 7:
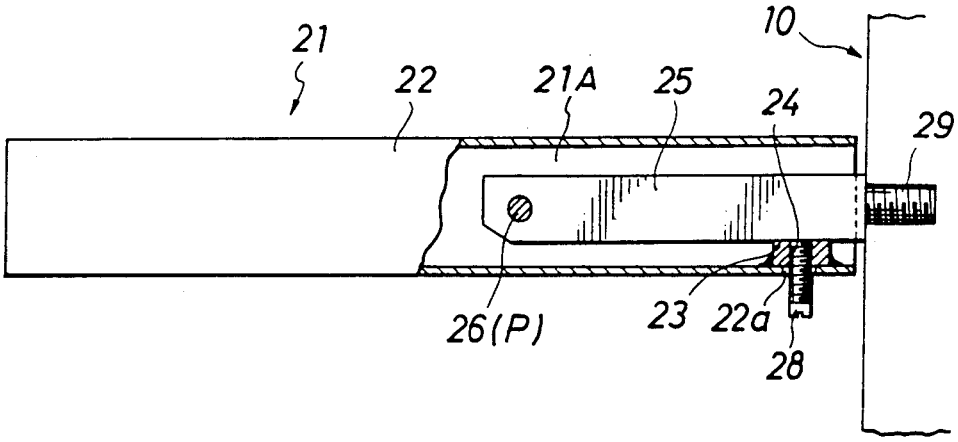
FIG. 7 is a longitudinal partially sectioned view of a supporting device according to another embodiment of this invention.

FIG. 7 shows a modified or simplified supporting device 21 in which the adaptor is dispensed with. In this embodiment, the basic rod member 25 is provided on its one end with a bolt-like connecting portion 29. The basic rod member 25 is directly inserted into the housing portion 21A of the outer cylindrical member 22, and rotatably connected to the outer cylindrical member 22 via bearing portions 23*a*.

Meanwhile, the outer cylindrical member 22 is provided on its bottom with a screw hole 24. To be more specific, the screw hole 24 is formed in a nut 23 fixed to the outer cylindrical member 22 in this embodiment, and a through hole 22*a* is so formed on the outer cylindrical member 22 as to communicate with the screw hole 24.

An adjustment screw 28 is screwed into the screw hole through the through hole 22*a* with its distal end being adapted to be contacted with the bottom surface of the basic rod member 25.

Other constructions are the same as those of previous embodiment.

When the connecting portion 29 is fixed to the display apparatus 10 thereby to fasten the basic rod member 25 to the display apparatus 10, the outer cylindrical member 22 is rotated around the pivot point "P", as the point of balance of the outer cylindrical member 22 is shifted from the pivot point "P", until the nut 23 is contacted with the bottom surface of the basic rod member 25 thereby to keep the horizontal state of the outer cylindrical member 22.

When the adjustment screw 28 is screwed forward to push the bottom surface of the basic rod member 25, the outer cylindrical member 22 is caused to rotate in such a way that the distal end portion of the outer cylindrical member 22 is raised upward and the proximal end thereof is departed from the basic rod member 25.

The inclination of the outer cylindrical member 22 can be adjusted to any desirable degree by adjusting the insertion degree of the adjustment screw 28.

In above embodiments, a connecting member of screw type is employed for the connecting portion 9 and 29. However, the structure of the connecting portion 9 and 29 is not limited to as such, but various kinds of structure such as jack pin structure (not shown) as conventionally employed for a connector can be employed in place of a screw type connector.

Figure 8:
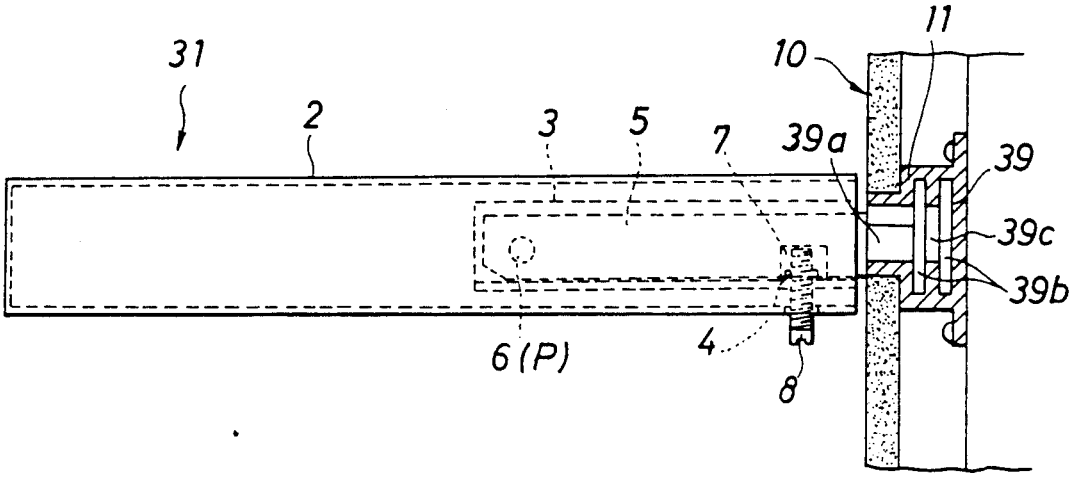
FIGS. 8 and 9 show modified embodiments of the connecting portion of the basic rod member.

For example, a connecting portion 39 of the basic rod member 5 shown in FIG. 8 comprises a pair of engaging pieces **39*b* provided at a small size boss 39*a* extending in the same axis of the basic rod member 5, and receiving device 11'** having double rails inside.

The engaging pieces **39*b* are formed in parallel through a neck portion 39*c* perpendicularly to the axis of the boss 39*a***, forming H-like figure in side view.

This connecting portion 39 of the basic rod member 5 can be engaged in a corresponding double rails of the receiving device 11 installed on the display apparatus 10.

Figure 9:
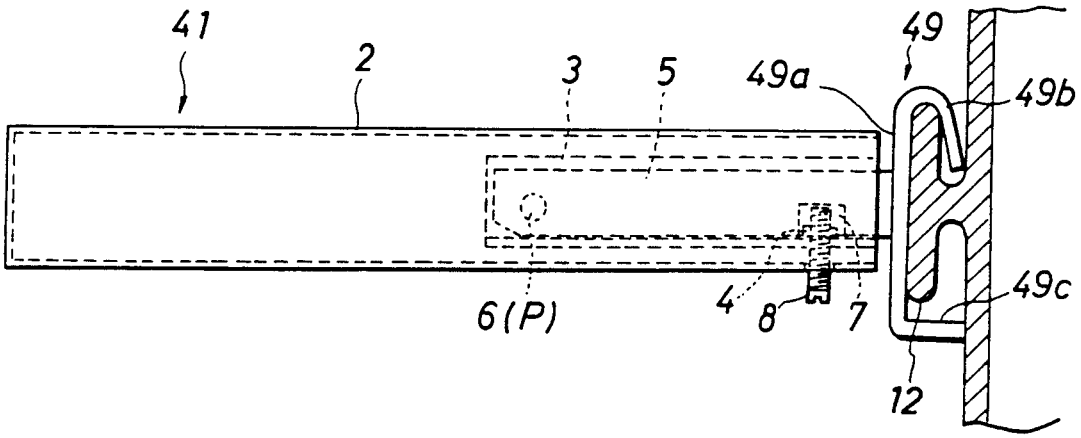

Another embodiment of a connecting portion 49 of the basic rod member 5 shown in FIG. 9 comprises a suspending piece **49*a* provided at the end of the basic rod member 5, extending perpendicularly to the longitudinal direction of the basic rod member 5, and the engaging bar 12 formed on the display apparatus 10**.

The suspending piece 49 is at least the upper end portion thereof being outwardly bent thereby forming a hook portion **49*b***.

Namely this connecting portion 49 of the rod member 5 is J-like figure in side view, and its hook portion **49*b* can be engaged with a groove formed receiving bar 12 of receiving panel. The reference numeral 49*c* indicates a stopper formed at the lower end of the suspending piece 49*a***.

Figure 10:
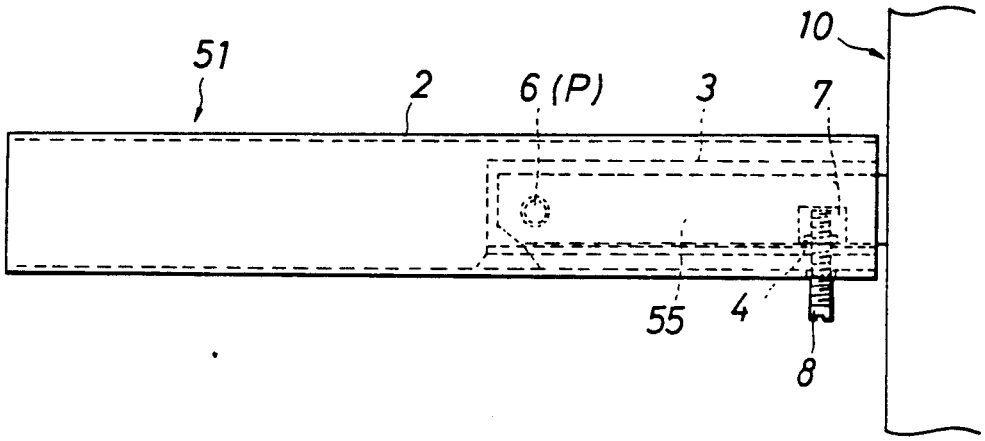
FIG. 10 shows a longitudinal sectional view of a supporting device wherein the connecting portion of the basic rod member is omitted.

It is also possible according to this invention to dispense with any connecting portion. For example, in an embodiment shown in FIG. 10, the basic rod member 55 is directly or integrally fixed to a display apparatus or to a display wall surface 10.

In the above embodiments, the pivot point 6(P) is set at the proximal end side of the balance point of the outer cylindrical member. However, it is also possible to set the pivot point 6(P) at the distal end side of the balance point of the outer cylindrical member so as to allow the distal end portion of the outer cylindrical member to be inclined downward.

As explained above, it is possible according to a supporting device for display having an inclination angle-adjustable structure to set the outer cylindrical member in any desired inclination posture by utilizing the pivoting position of the basic rod member in relative to the outer cylindrical member.

Moreover, since the inclination of the outer cylindrical member can be adjusted by adjusting the insertion degree of the adjustment screw, the inclination adjustment mechanism can be made simple in structure, and most of the mechanism can be built in the interior of the outer cylindrical member.

Accordingly, the components of the inclination adjustment mechanism can be effectively protected from an external impact, as well as from being spoiled by the invasion of external dust, thereby improving the durability of the supporting device. Further, since the most of the inclination adjustment mechanism is hidden by the outer cylindrical member, the external appearance of the supporting device can be made more attractive.

What is claimed is:

1. A supporting device comprising:

a basic rod member having a connecting portion adapted to be detachably connected to a display apparatus; an outer cylindrical having a hollow housing portion for receiving said basic rod member therein, said basic rod member comprising a distal end portion which is pivotally connected to an adaptor provided in the hollow housing portion of said outer cylindrical member, said adaptor being fixed to said outer cylindrical member and having a channel-like cross section;

wherein a space is preserved between said hollow housing portion and said basic rod member so as to allow a pivotal movement of said basic rod member in said hollow housing portion; and wherein and adjustment screw is inserted into a through hole provided in said outer cylindrical member and engages with a screw hole provided in a bottom surface of said adaptor in such a manner that a distal end portion of said screw is adapted to be brought into contact with said basic rod member so as to adjust an angle of inclination defined between said basic rod member and said outer cylindrical member.

2. A supporting device according to claim 1 wherein said connecting portion of said basic rod member extends in one direction and said basic rod member is pivotally connected to said adaptor at a position along the outer cylindrical member which is located in the one direction from a center of gravity of the outer cylindrical member.

3. A supporting device according to claim 2, wherein said basic rod member is rectangular in cross section and provided with a pair of pivots protruding from left and right sides of the distal end portion of said basic rod member and being rotatably fitted in holes formed on the side walls of a distal end portion of said adaptor.

4. A supporting device according to claim 1, wherein said basic rod member is in the form of square rod conforming to an internal shape of said adaptor with the distal end portion of said basic rod member that faces to the bottom surface of said adaptor being slantingly cut.

5. A supporting device according to claim 1, wherein said connecting portion is in the form of a screw rod portion extending from a main rod portion of said basic rod member.

6. A supporting device according to claim 1, wherein said connecting portion comprises a pair of engaging pieces extending perpendicularly to a longitudinal direction of the basic rod member and forming a connecting piece having an H-shaped cross-section.

7. A supporting device according to claim 1, wherein a connecting portion comprises a sustaining piece extending perpendicularly to a longitudinal direction of the basic rod member, at least an upper end portion of said sustaining piece being outwardly bent, thereby forming a hook portion.

8. A supporting device according to claim 1, wherein said basic rod is provided with a blind hole with which said screw hole is communicated and the distal end portion of said adjustment screw is contacted.

9. A supporting device according to claim 2, wherein said adjustment screw has a head portion whose outer diameter is the same as the maximum inner diameter of the screw hole so that the head portion can be sufficiently inserted into said through hole so as not to extend substantially from said through hole.

10. A supporting device according to claim 1, wherein said basic rod member is directly fixed to said display apparatus.

11. A supporting device comprising:

a basic rod member connected to and projecting forwardly from a surface of a display apparatus; an outer cylindrical member having a hollow housing portion for receiving said basic rod member therein, said basic rod member being pivotally mounted about a pinned connection provided within the outer cylindrical member wherein a space is defined between said hollow housing portion and said basic rod member so as to allow a pivotal movement of said basic rod member in said hollow housing portion; and wherein an adjustment screw is provided which engages with a screw hole supported at a bottom portion of said outer cylindrical member in such a manner that a distal end portion of said screw is adapted to be brought into contact with said basic rod member by rotating said screw, thereby causing the basic rod member to pivot relative to said outer cylindrical member so as to adjust an angle of inclination defined between said basic rod member and said outer cylindrical member.

12. A supporting device according to claim 11, wherein said basic rod member is pivotally connected relative to said outer cylindrical member at a position which is disposed on the same side of a center of gravity of said outer cylindrical member as said display apparatus.

13. A supporting device according to claim 11, wherein the basic rod member and the display apparatus are connected together by a threaded connection.

14. A supporting device according to claim 11, wherein the outer cylindrical member is characterized by comprising a circular cross-section which defines radial directions, and the adjustment screw extends in one of the radial directions of the outer cylindrical member.

15. A supporting device according to claim 11, wherein the basic rod member comprises an end portion which extends longitudinally beyond the outer cylindrical member and which is connected to the display apparatus.

* * * * *